US010351790B2

(12) United States Patent
Song et al.

(10) Patent No.: US 10,351,790 B2
(45) Date of Patent: Jul. 16, 2019

(54) APPARATUS FOR MOLDING GAS HYDRATE PELLETS

(71) Applicants: Dongguk University Industry-Academic Cooperation Foundation, Seoul (KR); Dongshin Hydraulics Co., Ltd., Busan (KR); Korea Gas Corporation, Seongnam-si, Gyeonggi-do (KR); SungilTurbine Co., Ltd., Busan (KR); Daewoo Engineering & Construction Co., Ltd., Seoul (KR)

(72) Inventors: Myung Ho Song, Seoul (KR); Yong Seok Yoon, Seoul (KR); In Kee Jung, Uijeongbu-si (KR); Jung Wook Kim, Seoul (KR); Seung Hee An, Ansan-si (KR); Sang Yup Jang, Ansan-si (KR); Jae Won Lee, Seoul (KR); Sang M. Kim, Busan (KR); Jin Seop Yang, Busan (KR); Ta-Kwan Woo, Busan (KR)

(73) Assignees: Dongguk University Industry-Academic Cooperation Foundation, Seoul (KR); Dongshin Hydraulics Co., Ltd., Busan (KR); Korea Gas Corporation, Seongnam-si (KR); Sungil Turbine Co., Ltd., Busan (KR); Daewoo Engineering & Construction Co., Ltd., Seoul (KR)

( * ) Notice: Subject to any disclaimer, the term of this patent is extended or adjusted under 35 U.S.C. 154(b) by 167 days.

(21) Appl. No.: 14/768,411

(22) PCT Filed: Jun. 27, 2013

(86) PCT No.: PCT/KR2013/005696

§ 371 (c)(1),
(2) Date: Aug. 17, 2015

(87) PCT Pub. No.: WO2014/208793

PCT Pub. Date: Dec. 31, 2014

(65) Prior Publication Data

US 2016/0002550 A1 Jan. 7, 2016

(51) Int. Cl.
*C10L 3/10* (2006.01)

(52) U.S. Cl.
CPC ..... *C10L 3/108* (2013.01); *C10L 2290/06* (2013.01); *C10L 2290/08* (2013.01);
(Continued)

(58) Field of Classification Search
CPC ..... C10L 3/108; B01F 7/00; C04B 7/00
(Continued)

(56) References Cited

U.S. PATENT DOCUMENTS 2,758 A * 8/1842 Lindley ..... B01F 7/00208 366/312
RE2,414 E * 12/1866 Blake ..... 241/83
(Continued)

FOREIGN PATENT DOCUMENTS

JP 2002220353 A * 8/2002 ..... F17C 11/007
JP 2003105362 A 4/2003
(Continued)

OTHER PUBLICATIONS

Recycle, Bypass, and Purge. Internet Archive Wayback Machine, University of Pittsburgh. Published Jul. 12, 2010. https://web.archive.org/web/20100712162652/http://pillars.che.pittedu/student/slide.cgi?course_id=12&slide_id-48.0.*
(Continued)

*Primary Examiner* — Robert C Dye
*Assistant Examiner* — Russell E Sparks
(74) *Attorney, Agent, or Firm* — Locke Lord LLP; Daniel J. Fiorello; James E. Armstrong, IV

(57) ABSTRACT

The present invention provides an apparatus for molding gas hydrate pellets that includes: a pulverizer in which dehydrated gas hydrates are pulverized; a cooler having a rotating shaft provided therein, comprising a plurality of agitation blades installed along a height direction of the rotating shaft and configured to cool the gas hydrates to a predetermined temperature; a decompressor configured to decompress the cooled gas hydrates to a predetermined pressure; and a pellet molder configured to mold the decompressed gas hydrates to pellets.

17 Claims, 7 Drawing Sheets

(52) U.S. Cl.
CPC ..... *C10L 2290/24* (2013.01); *C10L 2290/28* (2013.01); *C10L 2290/30* (2013.01); *C10L 2290/32* (2013.01); *C10L 2290/48* (2013.01)

(58) Field of Classification Search
USPC ..... 425/308
See application file for complete search history.

(56) References Cited

U.S. PATENT DOCUMENTS 449,942 A * 4/1891 Merralls ..... B07B 1/10 209/234
521,315 A * 6/1894 Hoffman ..... G05D 16/10 137/116.3
914,973 A * 3/1909 Pickett ..... B01F 15/0462 222/134
1,535,848 A * 4/1925 Nicholson ..... F25B 9/004 122/26
3,028,332 A * 4/1962 Van Den Berg ..... B01D 3/146 208/340
3,250,321 A * 5/1966 Root ..... B01F 15/065 165/94
5,429,223 A * 7/1995 Moeller ..... B65G 47/647 198/369.1
5,545,102 A * 8/1996 Burgman ..... F16H 37/082 475/230
5,851,058 A * 12/1998 Humbek ..... B62D 55/30 305/146
6,252,018 B1 * 6/2001 Rupaner ..... B01J 19/18 422/135
7,900,857 B2 * 3/2011 Medoff ..... C08H 8/00 241/23
2005/0059846 A1 * 3/2005 Kohda ..... C10L 3/10 585/15
2010/0012756 A1 * 1/2010 Medoff ..... C08H 8/00 241/23

FOREIGN PATENT DOCUMENTS

JP 2005-264105 A 9/2005
JP 2006124532 A 5/2006
JP 2007-254503 A 10/2007
JP 2007-262376 A 10/2007
JP 2007-270031 A 10/2007
KR 2013-0030679 A 3/2013

OTHER PUBLICATIONS

Lubrication Basics. Internet Archive Wayback Machine, Noria Corporation, Published May 16, 2012. https://web.archive.org/web/20120516004636/http://machinerylubrication.com/Read/24100/lubrication-basics.*
Sea-Japan. Natural gas (NGH) carrier imaged for next-generation energy. Eureka International Inc. http://www.jsea.or.jp/wp/wp-content/uploads/2015/06/Sea298.pdf.*
Machine Translation of JP 2002220353 A. Espacenet. Published Aug. 9, 2002.*
Machine Translation of JP 2007270031 (Year: 2007).*
International Search Report for PCT/KR2013/005696 dated Mar. 25, 2014.
Korean Office Action dated May 31, 2016, issued in corresponding Korean Registration No. 10-1692260.

* cited by examiner

APPARATUS FOR MOLDING GAS HYDRATE PELLETS

CROSS-REFERENCE TO RELATED APPLICATIONS

This application is the national phase under 35 U.S.C. § 371 of PCT International Application No. PCT/KR2013/005696, filed Jun. 27, 2013, the entire contents of the aforementioned application is hereby incorporated herein by reference.

BACKGROUND

1. Technical Field

The present invention relates to an apparatus for molding gas hydrate pellets, more specifically to an apparatus for molding gas hydrate pellets that improves cooling efficiency by keeping the gas hydrate pellets from being adhered with one another in a cooler.

2. Background Art

Natural gas is a clean fossil fuel of which the demand has skyrocketed globally and the resource development has been fiercely competed because it generates significantly smaller quantities of carbon dioxide per fuel mass during the combustion than coal and petroleum.

Natural gas that is produced from gas fields is used as fuel through transportation and storage processes after removing mostly sulfur, carbon dioxide, water and polymer hydrocarbon but methane.

Since the price of natural gas is mostly dependent upon the facility and operation costs of implementing the above processes in addition to the margin and interest, the most economical transportation and storage method is selected, considering various factors such as the size of the gas field and the distance to the consumer. The most typical marine transportation method is the LNG (liquefied natural gas) method, and the compressibility of LNG is about 600 when it is normal condition methane.

Nonetheless, the economic feasibility of the LNG method is restricted due to the cryogenic requirement of LNG, and thus the LNG method is applicable for gas fields larger than a specific scale (i.e., currently at least about 3 trillions of cubic feet).

In order for methane, which is the main component of natural gas, to exist stably as a liquid under atmospheric pressure, the temperature needs to be −162 degrees Celsius or lower. Accordingly, metal materials used in the LNG facility exposed to cryogenic conditions need to include high concentrations of expensive nickel so as to minimize the brittleness. Moreover, due to a great difference in temperature between the inside and the outside during the transportation and storage processes, heat influx causes a large amount of BOG (boil off gas) generation.

In order to achieve economic feasibility of developing relatively small scale gas fields by overcoming these shortcomings and saving production costs of natural gas, GTS (gas to solid) technologies have been widely studied to transport/store natural gas using solid gas hydrate as storage medium. Particularly, in 1990, a Norwegian professor, named Prof. Gudmundsson, presented the self-preservation effect theory of hydrate to motivate many industrialized nations, such as Japan, to develop key technologies required for realizing commercial GTS methods.

Natural gas hydrate (NGH), which is a crystalline mixture in which natural gas molecules are encapsulated within solid state lattices of hydrogen-bonding water molecules, has an external shape that is similar to ice and maintains its solid state stably if a pressure that is higher than a certain value is applied at a given temperature. In order for methane hydrate to stably exist thermodynamically under atmospheric pressure, the temperatures needs to be −80 degrees Celsius or lower, but the self-preservation effect of delaying the decomposition of hydrate for several weeks is discovered when ice film is formed on the surface of a hydrate particle at temperatures of about −20 degrees Celsius.

The gas compressibility of NGH is about 170 (that is, about 170 cc of normal condition natural gas is stored in 1 cc of hydrate), which is more disadvantageous than LNG, but the temperature condition for transportation and storage of NGH is more advantageous. Accordingly, it has been theoretically verified that the GTS method using NGH is an economically alternative option of the LNG method for small-to-medium scale gas fields.

The elemental technologies constituting the GTS method include the NGHP (natural gas hydrate pellet) production technology, which transforms natural gas to the pellet type of hydrate before transporting/storing natural gas, and the regasification technology, which recovers natural gas by decomposing the NGH afterwards.

The GTS technology chain involves production, transportation/storage and regasification processes. In the production process, the gaseous state of gas is processed to a solid state of gas hydrate pellets. Specifically the production process consists of manufacturing gas hydrate slurry from gas and water under a relatively high-pressure, low-temperature environment, dehydrating the gas hydrate slurry to convert the gas hydrate slurry to a relatively hard gas hydrate cake having a small amount of residual water, cooling the gas hydrate cake to the self-preservation effect temperature of near −20 degrees Celsius, decompressing the cooled gas hydrate from the production pressure to atmospheric pressure, and molding a relatively large pellets from the cooled and decompressed powder or relatively small lumps of gas hydrate by use of briquetting or the like.

The related art is disclosed in Korean Patent Publication No. 2009-0124967 (PROCESS AND APPARATUS FOR PRODUCING THERMOPLASTIC RESIN PELLETS; laid open on Dec. 3, 2009).

SUMMARY

An embodiment of the present invention provides an apparatus for molding gas hydrate pellets that can improve a cooling efficiency by having a plurality of agitation blades installed inside a cooler to keep gas hydrates from being adhered.

An embodiment of the present invention provides an apparatus for molding gas hydrate pellets that includes: a pulverizer in which dehydrated gas hydrates are pulverized; a cooler having a rotating shaft provided therein, comprising a plurality of agitation blades installed along a height direction of the rotating shaft and configured to cool the gas hydrates to a predetermined temperature; a decompressor configured to decompress the cooled gas hydrates to a predetermined pressure; and a pellet molder configured to mold the decompressed gas hydrates to pellets.

The plurality of agitation blades may have a different speed of rotation from one another.

The apparatus for molding gas hydrate pellets may further include a roller unit coupled to the rotating shaft and configured to frictionally roll against an inner circumferential surface of the cooler.

The roller unit may include: a pair of first rollers formed to be separated by 180 degrees about the rotating shaft; and a pair of second rollers, each overlapped partially with the pair of first rollers in a lengthwise direction of the rotating shaft, and formed to be separated by 180 degrees about the rotating shaft so as to have a phase difference of 90 degrees from the pair of first rollers along the inner circumferential surface of the cooler.

The apparatus for molding gas hydrate pellets may further include: a first roller support formed between the first roller and the rotating shaft and configured to support the first roller; and a second roller support formed between the second roller and the rotating shaft and configured to support the second roller. The first roller support and the second roller support may each include a roller spring so as to allow the first roller and the second roller to be in close contact with the inner circumferential surface of the cooler.

The apparatus for molding gas hydrate pellets may further include an agitation blade support formed between the plurality of agitation blades and the rotating shaft and configured to support the plurality of agitation blades. A lubrication surface may formed between the agitation blade support and the rotating shaft, and the first roller support, the second roller support and the agitation blade, provided in plurality, may be each connected with a bevel gear.

The bevel gear formed above the first roller support and the bevel gear formed below the second roller support may be each fixably coupled to the rotating shaft.

The cooler may further include: a cooling gas inlet formed at a lower portion of the cooler for injection of cooling gas; and a cooling gas outlet formed at an upper portion of the cooler for discharge of cooling gas to an outside.

The apparatus for molding gas hydrate pellets may further include a belt conveyor configured to transfer the decompressed gas hydrate pellets to the pellet molder. The belt conveyor may be a mesh belt conveyor having a predetermined size of mesh.

The apparatus for molding gas hydrate pellets may further include a transfer part configured to receive the gas hydrate pellets having passed the mesh of the conveyor belt and transfer the gas hydrate pellets to the pellet molder.

The belt conveyor may have a direction thereof controlled toward the pellet molder or away from the pellet molder.

The pellet may include a briquetting machine, and the transferred gas hydrate pellets may be molded by the briquetting machine to first pellets having a greater diameter than that of the gas hydrate pellets.

The apparatus for molding gas hydrate pellets may further include a storage configured to collect and store second pellets collected when the belt conveyor is directed away from the pellet molder and the first pellets thrilled by the briquetting machine.

The decompressor may include: a decompression chamber having the cooled gas hydrates received therein for decompression; and a plurality of pressure tanks connected to the decompression chamber and each having a different pressure.

The plurality of pressure tanks may include: a first pressure tank; a second pressure tank having a lower pressure than the first pressure tank; a third pressure tank having a lower pressure than the second pressure tank; and a fourth pressure tank having a lower pressure than the third pressure tank.

The fourth pressure tank may be configured for maintaining atmospheric pressure and for having boil of gas (BOG) supplied thereto, the BOG being generated by the pellet molder.

The fourth pressure tank, the third pressure tank and the second pressure tank may be each configured to supply gas to the third pressure tank, the second pressure tank and the first pressure tank, respectively, if the fourth pressure tank, the third pressure tank and the second pressure tank each have a pressure that is greater than or equal to a predetermined value.

With the embodiments of the present invention, it is possible to improve a cooling efficiency by having a plurality of agitation blades installed inside a cooler to keep gas hydrates from being adhered during cooling.

DETAILED DESCRIPTION

Figure 1:
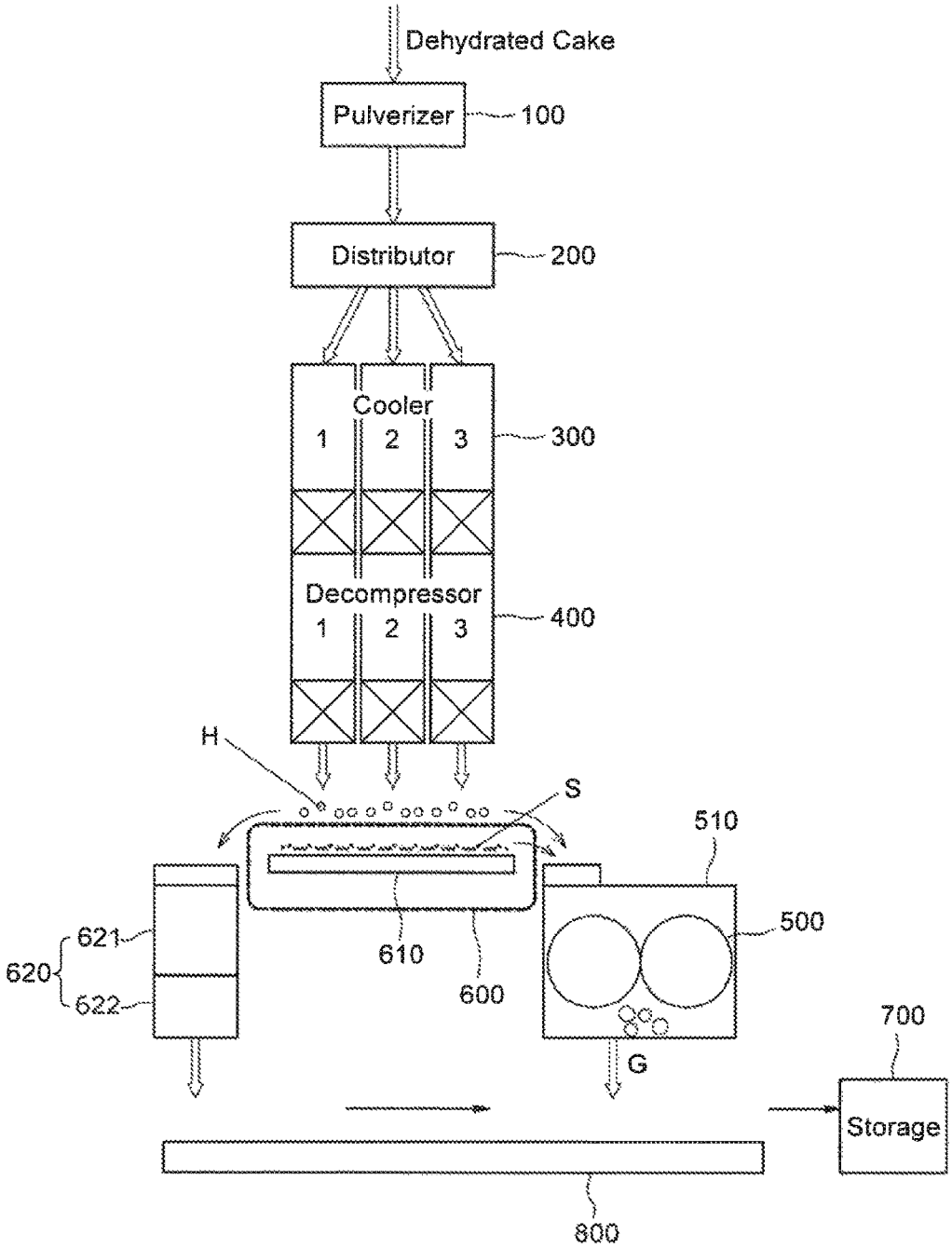
FIG. 1 shows an apparatus for molding gas hydrate pellets in accordance with an embodiment of the present invention.

Since there can be a variety of permutations and embodiments of the present invention, a certain embodiment will be illustrated and described with reference to the accompanying drawings. This, however, is by no means to restrict the present invention to a certain embodiment, and shall be construed as including all permutations, equivalents and substitutes covered by the ideas and scope of the present invention. Throughout the description of the present invention, when describing a certain relevant conventional technology is determined to evade the point of the present invention, the pertinent detailed description will be omitted.

Terms such as "first" and "second" can be used in describing various elements, but the above elements shall not be restricted to the above terms. The above terms are used only to distinguish one element from the other.

The terms used in the description are intended to describe certain embodiments only, and shall by no means restrict the present invention. Unless clearly used otherwise, expressions in a singular form include a meaning of a plural form. In the present description, an expression such as "comprising" or "including" is intended to designate a characteristic, a number, a step, an operation, an element, a part or combinations thereof, and shall not be construed to preclude any presence or possibility f one or more other characteristics, numbers, steps, operations, elements, parts or combinations thereof.

Hereinafter, a certain embodiment of an apparatus for storing gas hydrate pellets in accordance with the present invention will be described in detail with reference to the accompanying drawings. Identical or corresponding elements will be given the same reference numerals, regardless of the figure number, and any redundant description of the identical or corresponding elements will not be repeated.

Figure 2:
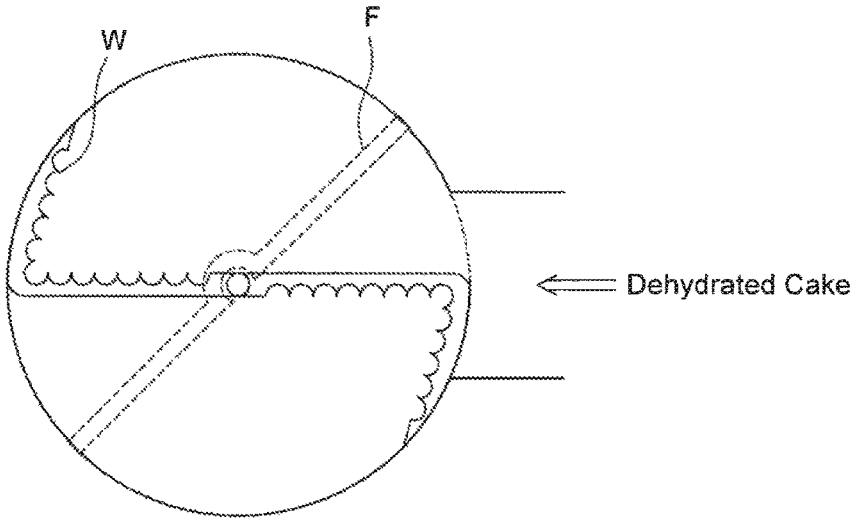
FIG. 2 shows a pulverizer of the apparatus for molding gas hydrate pellets in accordance with an embodiment of the present invention.
Figure 3:
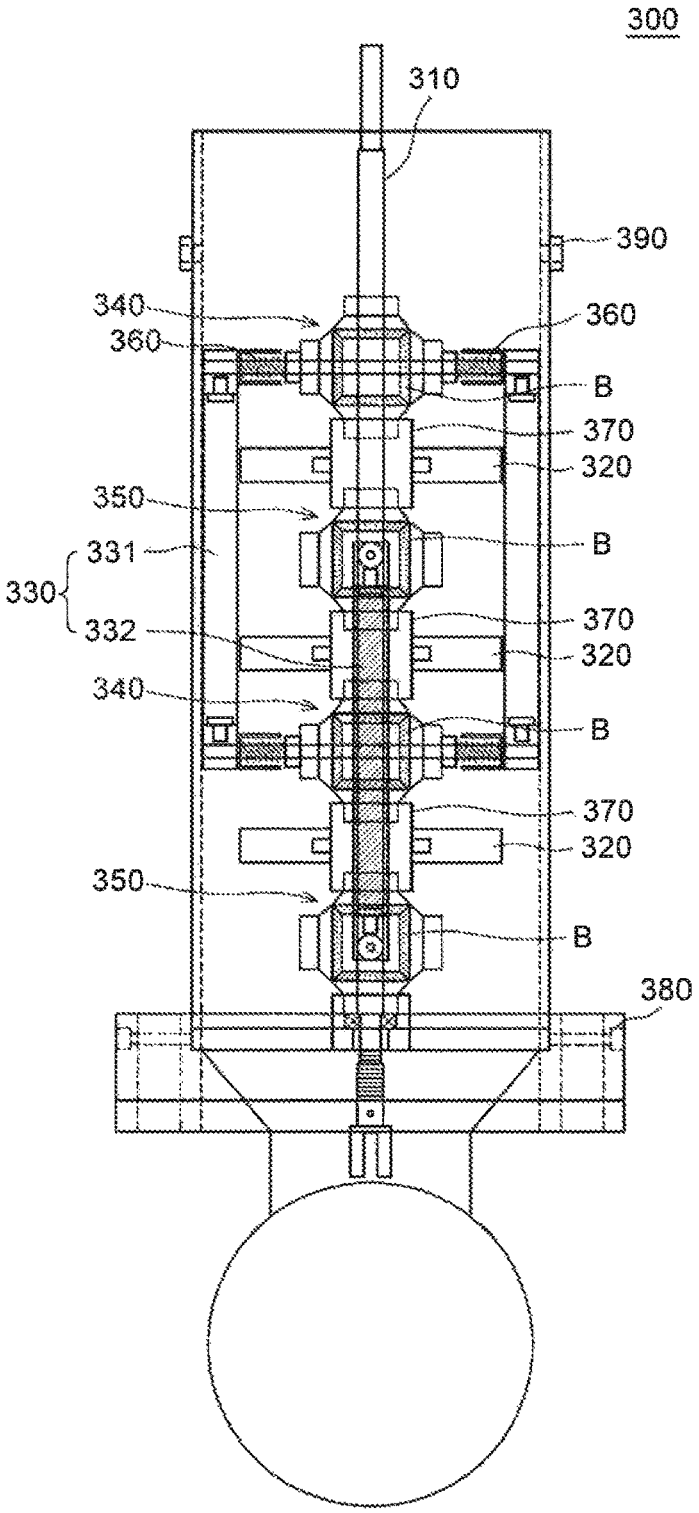
FIG. 3 shows a cooler of the apparatus for molding gas hydrate pellets in accordance with an embodiment of the present invention.
Figure 4:
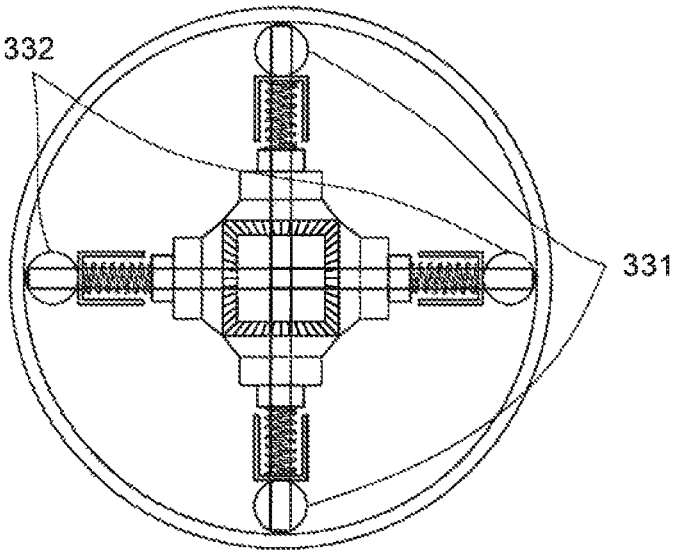
FIG. 4 shows a first roller and a second roller of the cooler of the apparatus for molding gas hydrate pellets in accordance with an embodiment of the present invention.
Figure 5:
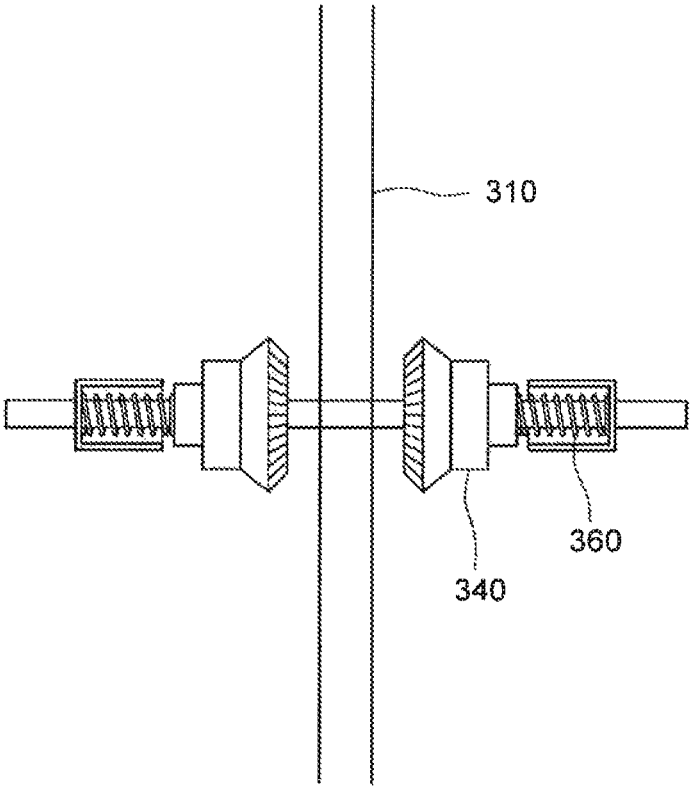
FIG. 5 shows a rotating shaft and a roller support of the cooler of the apparatus for molding gas hydrate pellets in accordance with an embodiment of the present invention.
Figure 6:
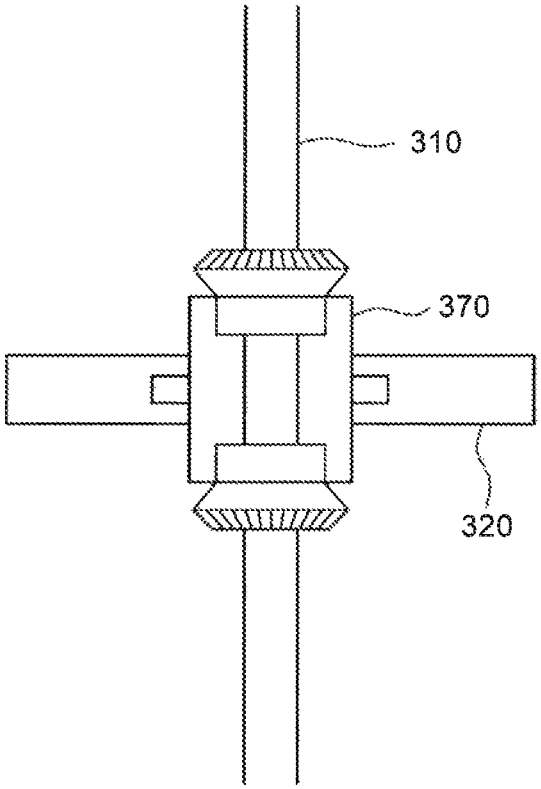
FIG. 6 shows the rotating shaft and an agitation blade support of the cooler of the apparatus or molding gas hydrate pellets in accordance with an embodiment of the present invention.
Figure 7:
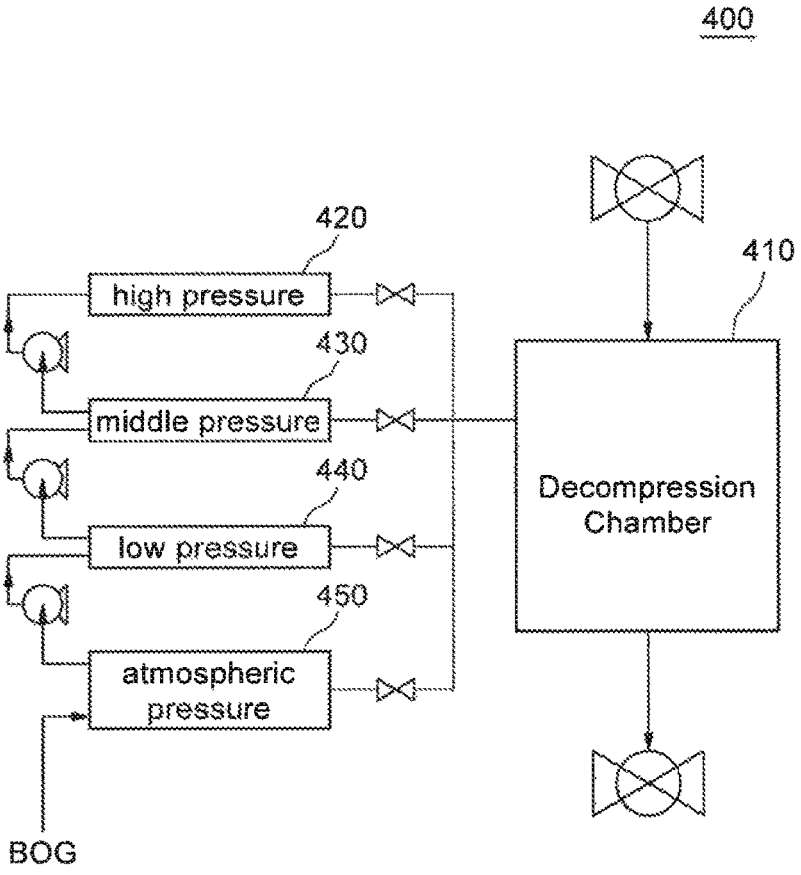
FIG. 7 shows a decompressor of the apparatus for molding gas hydrate pellets in accordance with an embodiment of the present invention.

FIG. 1 shows an apparatus for molding gas hydrate pellets in accordance with an embodiment of the present invention. FIG. 2 shows a pulverizer of the apparatus for molding gas hydrate pellets in accordance with an embodiment of the present invention. FIG. 3 shows a cooler of the apparatus for molding gas hydrate pellets in accordance with an embodiment of the present invention. FIG. 4 shows a first roller and a second roller of the cooler of the apparatus for molding gas hydrate pellets in accordance with an embodiment of the present invention. FIG. 5 shows a rotating shaft and a roller support of the cooler of the apparatus for molding gas hydrate pellets in accordance with an embodiment of the present invention. FIG. 6 shows the rotating shaft and an agitation blade support of the cooler of the apparatus for molding gas hydrate pellets in accordance with an embodiment of the present invention. FIG. 7 shows a decompressor of the apparatus for molding gas hydrate pellets in accordance with an embodiment of the present invention.

As shown in FIG. 1, an apparatus for molding gas hydrate pellets in accordance with an embodiment of the present invention includes a pulverizer 100, a cooler 300, a decompressor 400 and a pellet molder 510.

After dehydration, gas hydrates become spherical, cylindrical or capsule-type lumps of solids that have an effective diameter of 30 mm or more and require an excessive time for cooling.

Accordingly, between the dehydration process and the cooling process, the apparatus for molding gas hydrate pellets in accordance with an embodiment of the present invention may pulverize the gas hydrates to reduce the effective diameter, thereby shortening the time required for cooling owing to the reduced effective diameter.

The pulverizer 100 may include, as shown in FIG. 2, a fixed blade F and a wing blade W, and the gas hydrates injected into the pulverizer 100 may be pulverized by a compressive force between the wing blade W and the fixed blade F caused by rotation of the wing blade W.

As any residual moisture unremoved from the dehydration process may be coagulated and freeze-adsorbed to cause blockage and damage, the apparatus for molding gas hydrate pellets in accordance with the present invention may solve this problem by using a plurality of agitation blades 320 in the cooling process.

Moreover, the wing blade W may have serration formed thereon to enhance a pulverization efficiency of the gas hydrates.

By distributing the pulverized gas hydrates to a plurality of coolers 300 and providing a plurality of decompressors 400 below the plurality of coolers 300, respectively, it is possible to address variations of cooling time and decompression time required for molding the gas hydrate pellets and to mold various sizes of gas hydrate pellets by adjusting the cooling time and the decompression time.

The cooler 300, which receives the pulverized gas hydrates and cools the received gas hydrates below a predetermined temperature, may include a rotating shaft 310 and a plurality of agitation blades 320 formed about the rotating shaft 310.

By using the agitation blades 320, it is possible to reduce the overall cooling time and hence the overall processing amount.

Here, the cooler 300 may be provided in plurality, and the pulverized gas hydrates may be distributed to the plurality of coolers 300 before being injected.

The agitation blades 320, which are revolved by the rotation of the rotating shaft 310, may reduce adhesion of the gas hydrate pellets that may occur in the cooler 300.

Here, the plurality of agitation blades 320 have each a different revolving speed to efficiently reduce the adhesion or freeze-adsorption problem of e gas hydrates injected into the cooler 300.

As shown in FIG. 3, the cooler 300 of the apparatus for molding gas hydrate pellets in accordance with an embodiment of the present invention may further include a roller unit 330.

The roller unit 330 has one end thereof coupled to the rotating shaft 310 and the other end thereof formed to nearly touch an inner circumferential surface of the cooler 300, and includes rollers so as to frictionally roll against the inner circumferential surface of the cooler 300.

Here, the roller unit 330 may include a pair of first rollers 331, which are separated by 180 degrees about the rotating shaft 310, and a pair of second rollers 332, which are separated by 180 degrees about the rotating shaft 310 so as to have a phase difference of 90 degrees from the pair of first rollers 331 along the inner circumferential surface of the cooler 300.

That is, as illustrated in FIG. 4, when viewed from above, the pair of first rollers 331 and the pair of second rollers 332 intersect orthogonally to one another about a center of the cooler 300. However, the pair of first rollers 331 may be installed above the pair of second rollers 332 so as to appear partially overlapped with one another.

Here, referring to FIG. 5, a first roller support 340 configured for supporting the first roller 331 is formed in between the first roller 331 and the rotating shaft 310, and a second roller support 350 configured for supporting the second roller 332 is formed in between the second roller 332 and the rotating shaft 310.

Moreover, the first roller support 340 and the second roller support 350 each have a roller spring 360 provided therein so as to allow the first roller 331 and the second roller 332 to be in close contact with the inner circumferential surface of the cooler 300.

By allowing the first roller 331 and the second roller 332 to be in close contact with the inner circumferential surface of the cooler 300, it becomes possible to efficiently separate the gas hydrate pellets that may be adhered on the inner circumferential surface of the cooler 300.

Moreover, in such a case, the first roller 331 and the second roller 332 each not only revolve along the inner circumferential surface of the cooler 300 but also rotate, it becomes possible to separate the gas hydrate pellets freeze-adsorbed to the inner circumferential surface of the cooler 300 more efficiently, thereby improving the efficiency of the cooling process and reducing the time required for the cooling process.

By improving the efficiency of the cooling process and reducing the time required for the cooling process, the overall processing time is reduced, and thus the efficiency of molding the gas hydrate pellets may be improved.

Referring to FIG. 3 and FIG. 6, the apparatus for molding gas hydrate pellets in accordance with the present invention may further include an agitation blade support 370 and have a lubrication surface formed between the agitation blade support 370 and the rotating shaft 310 so that the agitation blades 320 are not fastened to the rotating shaft 310.

The agitation blade support 370 is formed between the plurality of agitation blades 320 and the rotating shaft 310 to support the plurality of agitation blades 320, and the agitation blade support 370, which is provided in plurality, the first roller support 340 and the second roller support 350 may be each connected with a bevel gear B.

Moreover the bevel gear B formed above the first roller support 340 and the bevel gear B formed below the second roller support 350 are each fixably coupled to the rotating shaft 310.

The bevel gear B placed outermost is fixed and thus does not rotate despite the rotation of the rotating shaft 310, and the first roller 331 and the second roller 332 are fixably coupled to the rotating shaft 310 to rotate together with the rotating shaft 310. As the first roller support 340, the second roller support 350 and the plurality of agitation blades 320 are each connected with the bevel gear B, the speed of rotation of the first roller 331 and the second roller 332 is different from the speed of rotation of the plurality of agitation blades 320.

As illustrated in FIG. 3, in the apparatus for molding gas hydrate pellets in accordance with an embodiment of the present invention, the agitation blades 320 of the cooler 300 may be each formed between the first roller support 340 and the second roller support 350.

As the rotating shaft 310 rotates, the first roller 331 and the second roller 332 that are fixed to the rotating shaft 310 rotate also at the speed of rotation of the rotating shaft 310, and the first roller support 340 and the agitation blade 320 in the middle of the three agitation blades 320 connected with the first roller support 340 through the bevel gear B remain stationary without rotation, but the remaining two agitation blades 320 rotate at a speed that is twice the speed of rotation of the first roller 331 and the second roller 332.

By applying the principle of differential gear by use of the above-described bevel gear B to the agitation on blades 320, the first roller 331 and the second roller 332 inside the cooler 300 to differentiate respective speeds of rotation, it becomes possible to reduce the adhesion or freeze-adsorption problem of the gas hydrate pellets by improving the efficiency of agitation inside the cooler 300.

As shown in FIG. 3, the cooler 300 of the present invention may further include a cooling gas inlet 380 formed at a lower portion of the cooler 300 for injecting cooling gas into the cooler 300 and a cooling gas outlet 390 formed at an upper portion of the cooler 300 for discharging the cooling gas to an outside.

The temperature inside the cooler 300 may be adjusted by adjusting the temperature and quantity of the cooling gas injected through the cooling gas inlet 380 or discharged through the cooling gas outlet 390.

Referring to FIG. 1 and FIG. 7, the gas hydrate pellets that have passed through the cooler 300 are transferred to the decompressor 400 for decompression.

The decompressor 400 may include a decompression chamber 410, in which the gas hydrate pellets are received for decompression, and a plurality of pressure tanks, each having a different pressure, connected to the decompression chamber 410.

The plurality of pressure tanks include a first pressure tank 420, a second pressure tank 430 having a lower pressure than the first pressure tank 420, a third pressure tank 440 having a lower pressure than the second pressure tank 430, and a fourth pressure tank 450 having a lower pressure than the third pressure tank 440.

Moreover, intermediate pressure tanks may be installed for economical operation of pressure decrease and increase repeated in the decompression process.

FIG. 7 is provided to illustrate the intermediate pressure tanks and a piping system used for pressure decrease and increase between atmospheric pressure and about 50 bar, which is a molding pressure for gas hydrate pellets in accordance with an embodiment of the present invention.

In the case where a valve that is opened and closed momentarily is used for automatic operation of decompression devices, it is preferable that a pressure difference between either side of the valve be within 20 bar in order to prevent a damage in high-pressure containers and pipes and to prevent an accident.

Provided accordingly may be the first pressure tank 420 maintaining an internal pressure of about 50 bar, the second pressure tank 430 maintaining an internal pressure of around 30 bar, the third pressure tank 440 maintaining an internal pressure of around 10 bar, and the fourth pressure tank 450 maintaining an internal pressure around atmospheric pressure.

The pressure of the decompression chamber 410 is dropped from 50 bar to atmospheric pressure through the following steps. 1) The valve connecting the decompression chamber 410 with the second pressure tank 430 is opened, and then the valve is closed when the pressure difference between the decompression chamber 410 and the second pressure tank 430 is reduced to be within a predetermined pressure (e.g., 2 bar). 2) The valve connecting the decompression chamber 410 with the third pressure tank 440 is opened, and then the valve is closed when the pressure difference between the decompression chamber 410 and the third pressure tank 440 is reduced to be within a predetermined pressure (e.g., 2 bar). 3) The valve connecting the decompression chamber 410 with the fourth pressure tank 450 is opened, and then the valve is closed when the pressure difference between the decompression chamber 410 and the fourth pressure tank 450 is reduced to be within a predetermined pressure (e.g., 2 bar).

The pressure of the decompression chamber 410 is raised from atmospheric pressure to 50 bar through the following steps. 1) The valve connecting the decompression chamber 410 with the third pressure tank 440 is opened, and then the valve is closed when the pressure difference between the decompression chamber 410 and the third pressure tank 440 is reduced to be within a predetermined pressure (e.g., 2 bar). 2) The valve connecting the decompression chamber 410 with the second pressure tank 430 is opened, and then the valve is closed when the pressure difference between the decompression chamber 410 and the second pressure tank 430 is reduced to be within a predetermined pressure (e.g., 2 bar). 3) The valve connecting the decompression chamber 410 with the first pressure tank 420 is opened, and then the valve is closed when the pressure difference between the decompression chamber 410 and the first pressure tank 420 is reduced to be within a predetermined pressure (e.g., 2 bar).

The fourth pressure tank 450, which is for maintaining atmospheric pressure, may have boil off gas (BOG), which is generated from the pellet molder 510, supplied thereto.

If the pressure of the fourth pressure tank 450, the third pressure tank 440 and the second pressure tank 430 is each greater than equal to a predetermined value, the fourth pressure tank 450, the third pressure tank 440 and the second pressure tank 430 may supply gas to the third pressure tank 440, the second pressure tank 430 and the first pressure tank 420, respectively.

Moreover, the gas of the first pressure tank 420 may be consumed during the last step of pressure increase by the decompressor 400 and while producing gas hydrate slurry after an additional pressure increase.

Accordingly, it is possible to cut down the mass of high-pressure vas discharged during the decompression and collect and reuse some of the high-pressure gas discharged during the pressure increase.

In the case where the first pressure tank 420, the second pressure tank 430, the third pressure tank 440 and the fourth pressure tank 450 are shared by a plurality of decompressors 400, the pressure decrease or increase steps may be carried out simultaneously for individual decompressors 400, possibly delaying the opening and closing of the valve during the pressure decrease steps of the individual decompressors 400. Therefore, in an embodiment of the present invention, the volume of the first pressure tank 420, the second pressure tank 430, the third pressure tank 440 and the fourth pressure tank 450 may be each made to be sufficiently large, compared to the volume of the decompression chamber 410.

Referring to FIG. 1, the apparatus for molding gas hydrate pellets in accordance with an embodiment of the present invention may further include a belt conveyor 600.

The belt conveyor 600, which is configured for transferring the decompressed gas hydrate pellets to the pellet molder 510, may be a mesh belt conveyor having a predetermined size of mesh.

Some of the gas hydrate pellets dropped to the mesh conveyor belt pass through the mesh and are collected at a transfer part 610, which then transfers these gas hydrate pellets to the pellet molder 510, and the gas hydrate pellets that are bigger than the predetermined size are transferred by the mesh belt conveyor to the pellet molder 510 or a temporary storage 621, which stores the gas hydrate pellets temporarily.

That is, the direction of the belt conveyor 600 may be controlled toward the pellet molder 510 or away from the pellet molder 510 so that the gas hydrate pellets having passed the decompressor 400 are sent to the pellet molder 510 or to the temporary storage 621.

The pellet molder 510 may include a briquetting machine 500, and the gas hydrate pellets transferred to the pellet molder 510 may be molded to bigger, first pellets G.

Moreover, the gas hydrate pellets transferred to the temporary storage 621 are transferred to a storage 700 through a weighing distributor 622, which is formed beneath the temporary storage 621, and then a transporter 800.

Here, the first pellets G, which are molded in the pellet molder 510 to have a greater diameter, may be also transferred to and stored in the storage 700.

According to the present invention, the gas hydrate pellets having different sizes may be mixed and stored together, thereby lowering the porosity and improving the storage efficiency of the gas hydrate pellets.

Although a certain embodiment of the present invention has been described above, it shall be appreciated that there can be a variety of permutations and modifications of the present invention by those who are ordinarily skilled in the art to which the present invention pertains without departing from the technical ideas and scope of the present invention, which shall be defined by the appended claims. It shall be also appreciated that a large number of other embodiments than the above-described embodiment are included in the claims of the present invention.

What is claimed is:

1. An apparatus for molding gas hydrate pellets, comprising:

a dehydrating unit configured to remove moisture from a slurry state of gas hydrates to transform the slurry state of the gas hydrates to a cake state of the gas hydrates;

a pulverizer in which the cake state of the gas hydrates is pulverized;

a cooler having a rotating shaft provided therein, comprising a plurality of agitation blades installed along a height direction of the rotating shaft and configured to cool the pulverized gas hydrates to a predetermined temperature;

a decompressor configured to decompress the cooled gas hydrates to a predetermined pressure; and a pellet molder configured to mold the decompressed gas hydrates to pellets, wherein the pulverizer is configured to pulverize and decrease effective diameters of the gas hydrates converted into the cake after the dehydrating, wherein the gas hydrates pulverized in the pulverizer to have the effective diameters decreased are supplied to the cooler, and wherein the pulverizer includes a fixed blade and a wing blade, and the gas hydrates injected into the pulverizer are pulverized by a compressive force between the fixed blade and the wing blade caused by rotation of the wing blade.

2. The apparatus of claim 1, wherein the plurality of agitation blades have a different speed of rotation from one another.

3. The apparatus of claim 2, further comprising a roller unit coupled to the rotating shaft and configured to frictionally roll against an inner circumferential surface of the cooler.

4. The apparatus of claim 3, wherein the roller unit comprises:

a pair of first rollers formed to be separated by 180 degrees about the rotating shaft; and a pair of second rollers, each overlapped partially with the pair of first rollers in a lengthwise direction of the rotating shaft, and formed to be separated by 180 degrees about the rotating shaft so as to have a phase difference of 90 degrees from the pair of first rollers along the inner circumferential surface of the cooler.

5. The apparatus of claim 4, further comprising:

a first roller support formed between the first roller and the rotating shaft and configured to support the first roller; and a second roller support formed between the second roller and the rotating shaft and configured to support the second roller, wherein the first roller support and the second roller support each comprise a roller spring so as to allow the first roller and the second roller to be in close contact with the inner circumferential surface of the cooler.

6. The apparatus of claim 5, further comprising an agitation blade support formed between the plurality of agitation blades and the rotating shaft and configured to support the plurality of agitation blades, wherein a lubrication surface is formed between the agitation blade support and the rotating shaft, and wherein the first roller support, the second roller support and the agitation blade support, provided in plurality, are each connected with a bevel gear.

7. The apparatus of claim 6, wherein the bevel gear formed above the first roller support and the bevel gear formed below the second roller support are each fixably coupled to the rotating shaft.

8. The apparatus of claim 1, wherein the cooler further comprises:

a cooling gas inlet formed at a lower portion of the cooler for injection of cooling gas; and a cooling gas outlet formed at an upper portion of the cooler for discharge of cooling gas to an outside.

9. The apparatus of claim 1, further comprising a belt conveyor configured to transfer the decompressed gas hydrates to the pellet molder, wherein the belt conveyor is a mesh belt conveyor having a predetermined size of mesh.

10. The apparatus of claim 9, further comprising a transfer part configured to receive the gas hydrates having passed the mesh of the belt conveyor and transfer the gas hydrates to the pellet molder.

11. The apparatus of claim 10, wherein the belt conveyor has a direction thereof controlled toward the pellet molder or away from the pellet molder.

12. The apparatus of claim 10, wherein the pellet molder comprises a briquetting machine, and wherein the transferred gas hydrates are molded by the briquetting machine to first pellets having a greater diameter than that of the gas hydrates.

13. The apparatus of claim 12, further comprising a storage configured to collect and store second pellets collected when the belt conveyor is directed away from the pellet molder and the first pellets formed by the briquetting machine.

14. The apparatus of claim 1, wherein the decompressor comprises:

a decompression chamber having the cooled gas hydrates received therein for decompression; and a plurality of pressure tanks connected to the decompression chamber and each having a different pressure.

15. The apparatus of claim 14, wherein the plurality of pressure tanks comprise:

a first pressure tank;

a second pressure tank having a lower pressure than the first pressure tank;

a third pressure tank having a lower pressure than the second pressure tank; and a fourth pressure tank having a lower pressure than the third pressure tank.

16. The apparatus of claim 15, wherein the fourth pressure tank is configured for maintaining atmospheric pressure and for having boil off gas (BOG) supplied thereto, the BOG being generated by the pellet molder.

17. The apparatus of claim 16, wherein the fourth pressure tank, the third pressure tank and the second pressure tank are each configured to supply gas to the third pressure tank, the second pressure tank and the first pressure tank, respectively, if the fourth pressure tank, the third pressure tank and the second pressure tank each have a pressure that is greater than or equal to a predetermined value.

* * * * *